United States Patent [19]

Davis

[11] 4,013,128

[45] Mar. 22, 1977

[54] MODULAR FIRE PROTECTION SYSTEM

[75] Inventor: Robert F. Davis, Framingham, Mass.

[73] Assignee: Walter Kidde & Company, Inc., Clifton, N.J.

[22] Filed: Apr. 19, 1976

[21] Appl. No.: 677,916

[52] U.S. Cl. ..... 169/61; 169/28; 340/239 S; 340/253 B; 340/418

[51] Int. Cl.[2] ..... A62C 37/04; A62C 35/08

[58] Field of Search ..... 169/23; 26, 28, 56, 169/60–62, 5; 340/253 B, 418, 239 S

[56] References Cited

UNITED STATES PATENTS

| | | | |
|---|---|---|---|
| 2,373,819 | 4/1945 | Eaton | 169/28 |
| 2,814,795 | 11/1957 | Spooner | 340/253 B |
| 3,917,001 | 11/1975 | Davis et al. | 169/61 |
| 3,952,809 | 4/1976 | Osborne | 169/61 |

*Primary Examiner*—Robert S. Ward, Jr.
*Attorney, Agent, or Firm*—John E. Toupal

[57] ABSTRACT

Disclosed is a fire protection system including a plurality of suppressor modules, each having a plurality of extinguishing agent filled suppressor units, an activator associated with each of the units and activatable by electrical current flow to induce release of its extinguishing agent, a series circuit connecting the activators in series, and an initiator circuit for initiating electrical current flow to the activators. A detector responds to the presence of combustion products by activating the initiator circuits in a first plurality of the modules. Also responsive to activation of the initiator circuits in each of the first plurality of modules is a response relay that closes contacts to activate the initiator circuits in another plurality of modules. This in turn energizes additional response relays to close contacts that activate the initiator circuits in an additional plurality of the modules. Sequential activation of the suppressor units in individual modules continues in this manner until all suppressor units in all modules of the system have been activated.

10 Claims, 2 Drawing Figures

MODULAR FIRE PROTECTION SYSTEM

BACKGROUND OF THE INVENTION

This invention relates generally to fire protection systems and, more particularly, to fire protection systems in which a plurality of individual fire suppressor units are activated to extinguish a fire.

Certain fire protection systems employ a plurality of strategically located suppressor units, each including a vessel filled with a fire suppressing agent and an electrically operated release mechanism for inducing discharge of the agent in response to detection of a fire. When simultaneous operation of all suppressor units is desired, the system is provided typically with a control circuit that produces coincident activation of all release mechanisms. In such systems, it is common technique to electrically supervise the electric integrity of the release mechanisms by providing and monitoring a trickle current through a series connection thereof. Although this series supervision establishes a constant knowledge of release mechanism integrity, there remains the possibility that a single release member failure will cause failure of the entire series system. In addition, even a detected failure of a release mechanism can prevent system operation if the detected failure occurs coincidentally with a demand for system actuation.

A fire protection sytem directed toward solving these problems is described in U.S. Pat. No. 3,917,001. The system disclosed in that patent responds to the detection of a fire by initially establishing in a conventional manner, a flow of activating current through the suppressing agent release mechanisms which are connected in a series. However, after this initial stage of operation, a control circuit reconnects the release mechanisms in parallel across a power supply. Because of this series to parallel circuit transformation, the failure of a single release mechanism will not prevent activation of all other mechanisms during the parallel mode of operation. Although obviating many problems associated with series connected suppressor units, this system also exhibits certain disadvantages when used in applications requiring a large number of suppressor units. For example, the activation of a large number of suppressors connected in a parallel mode requires a large capacity power source capable of supplying the cumulative current requirements of all units. In addition, the series to parallel conversion requires that each suppressor unit be connected to a central control with two wires and requires a large number of relays for effecting the transformation. These factors add to the cost of the system while reducing its reliability.

The object of this invention, therefore, is to provide a more reliable, less costly fire protection system of the type employing a large number of individual suppressor units, all having electrically operated release mechanisms adapted for sympathetic activation.

SUMMARY OF THE INVENTION

The present invention is a fire protection system including a plurality of suppressor modules, each having a plurality of extinguishing agent filled suppressor units, an activator associated with each of the units and activatable by electrical current flow to induce release of its extinguishing agent, a series circuit connecting the activators in series, and an initiator circuit for initiating electrical current flow to the activators. A detector responds to the presence of combustion products by activating the initiator circuits in a first plurality of the modules. Also responsive to activation of the initiator circuits in each of the first plurality of modules is a response relay that closes contacts to activate the initiator circuits in another plurality of modules. This in turn energizes additional response relays to close contacts that activate the initiator circuits in an additional plurality of the modules. Sequential activation of the suppressor units in individual modules continues in this manner until all suppressor units in all modules of the system have been activated. Because individual modules are activated in response to activation of any of a plurality of other modules, the failure of a given module caused, for example, by the failure of an individual suppressor activator in that module will not induce failure of all other modules in the system. Furthermore, since the individual modules are connected only in series rather than for a series to parallel transformation, the overall cost of the system is reduced.

A feature of the invention is the use of relays with inherent time delays to sequentially activate the activators in successive modules. The sequential activation of modules allows them to time-share the power supply and thus eliminate current starvation or current hogging that could occur in a parallel system utilizing simultaneous activation of activators.

In a preferred embodiment of the invention, a control circuit establishes a continuous supervisory current flow through the activators in each module. The supervisory current flow is insufficient to induce release of extinguishing agent in each module, but provides monitored information regarding circuit continuity and integrity.

DESCRIPTION OF THE DRAWINGS

These and other objects and features of the invention will become apparent upon a perusal of the following specification taken in conjunction with the accompanying drawings wherein.

DESCRIPTION OF THE PREFERRED EMBODIMENT

Figure 1:
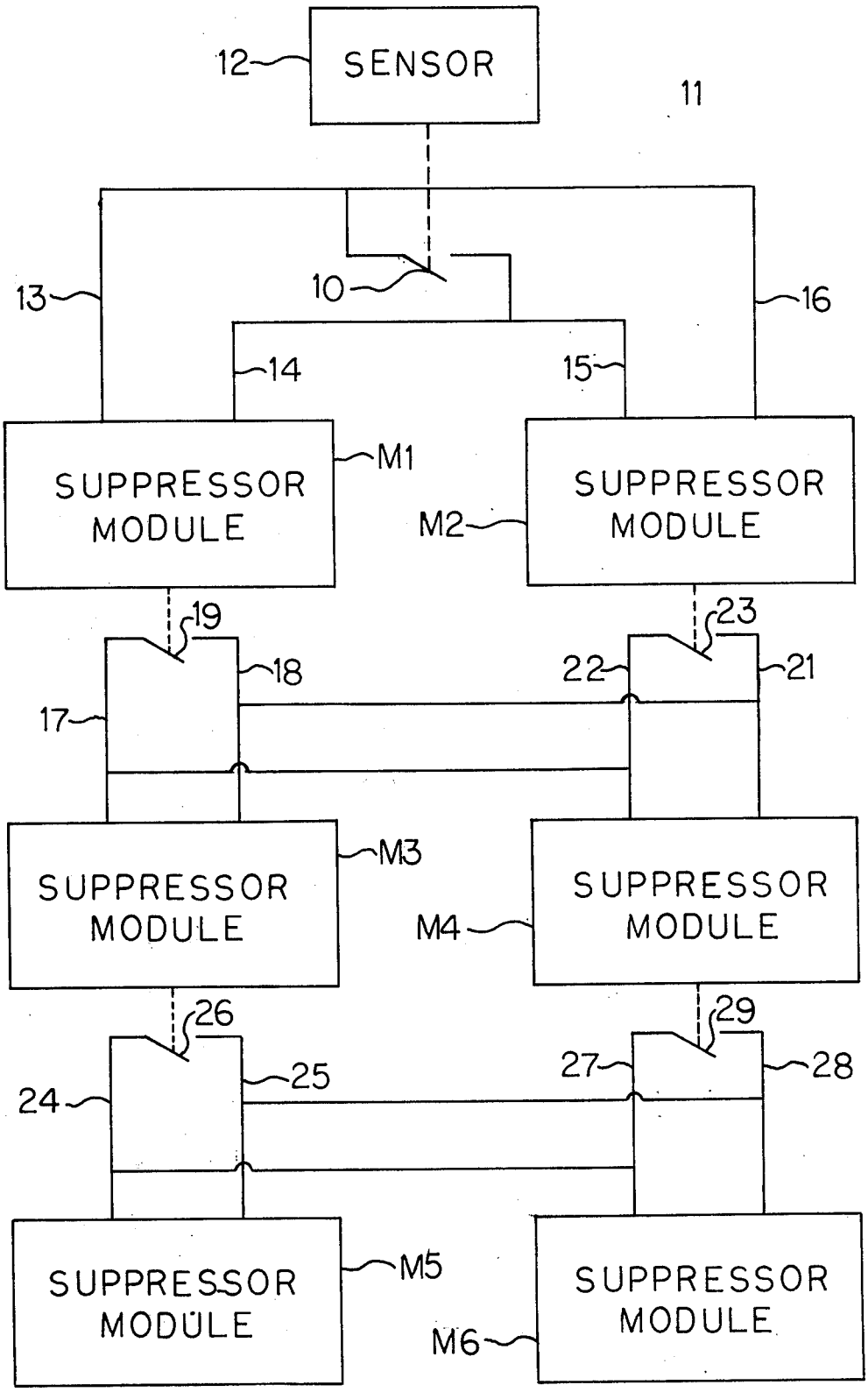
FIG. 1 is a schematic circuit diagram of a modular fire protection system according to the invention.

Illustrated in FIG. 1 is a fire protection system 11 including a plurality of modules M1, M2, M3, M4, M5, and M6. They are distributed throughout a fire-protected zone and their total number would be determined by the size of the zone and the particular application involved. Each module M1–M6 is powered by plus and minus lines of a conventional power supply. Connected to each of the modules M1 and M2, respectively, by wires 13, 14 and 15, 16 is a sensor 12 that closes a pair of contacts 10 in response to a given condition such as fire. The sensor 12 is conventional and can be, for example, a thermal switch such as disclosed in U.S. Pat. Nos. 2,537,028 and 3,423,585. A pair of lines 17 and 18 connect a pair of contacts 19 associated with the module M1 to each of the modules M3 and M4 which are also connected by lines 21 and 22 to a pair of contacts 23 associated with the module M2. Similarly, a pair of lines 24 and 25 connect a pair of contacts 26 associated with the module M3 to each of the modules M5 and M6 which are also both connected by lines 27 and 28 to a pair of contacts 29 associated with the module M4. It will be appreciated that any desired number of additional module pairs can be connected to the system 11 in the same manner.

Figure 2:
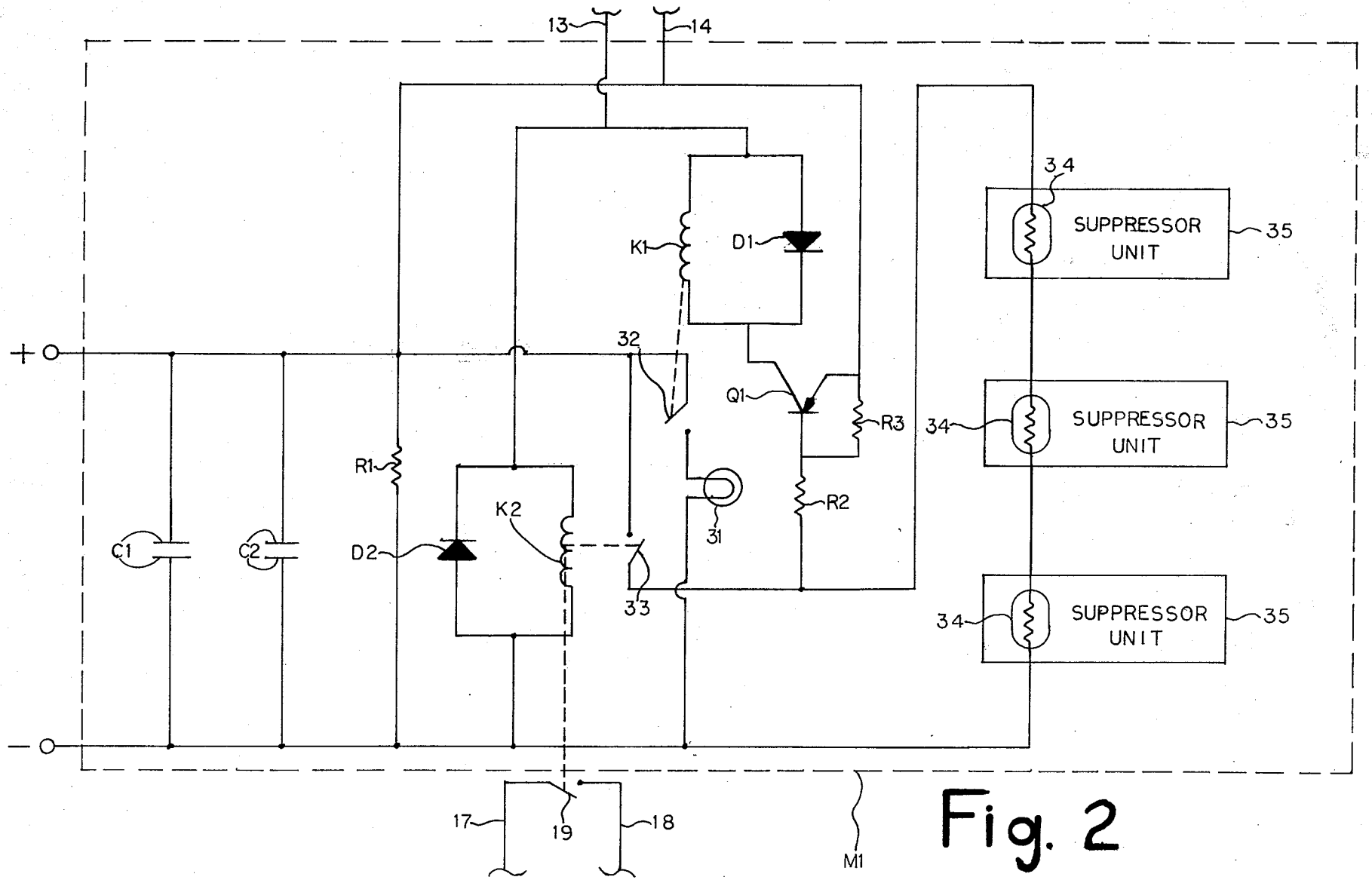
FIG. 2 is a schematic circuit diagram of one of the modules shown in FIG. 1.

Referring now to FIG. 2, there is shown a schematic circuit diagram of the module M1 shown in FIG. 1. It should be noted that each of the modules M2–M6 is identical to the module M1 depicted in FIG. 2. Connected across the supply are a pair of capacitors C1 and C2, a resistor R1 and the series combination of a signal lamp 31 and a pair of normally open relay contacts 32. The input line 14 is connected to the positive terminal of the supply and to a collector electrode of a transistor Q1. Also connected across the supply by normally open relay contacts 33 is a series combination of a plurality of explosive activator squibs 34 that can be detonated by a given magnitude of electrical current. Associated with each of the squibs 34 is a vessel 35 filled with a fire extinguisher medium that is released in response to detonation of the squib 34. The vessels 35 and activator squibs 34 are conventional and of a type, for example, disclosed in U.S. Pat. Nos. 2,693,240 and 3,523,583. Connecting the base of the transistor Q1 to a juncture between the contacts 33 and the series connected squibs 34 is a resistor R2. The input wire 13 is connected to the emitter of the transistor Q1 by a parallel combination of a diode D1 and a relay winding K1 that controls the contacts 32 and is connected to the negative terminal of the power supply by a parallel combination of a diode D2 and a relay winding K2 that controls both the contacts 33 and the contacts 19 shown in FIG. 1.

During normal operation of the module M1 shown in FIG. 2, the capacitors C1 and C2 are charged by the supply providing a voltage which produces current flow between the emitter and base electrodes of the transistor Q1, through the resistor R2 and through the series connected activator squibs 34. This base current causes the transistor Q1 to conduct a limited current of, for example, 5 milliamps that is of sufficient magnitude to energize the sensitive relay K1 but is insufficient to pull in the less sensitive relay K2. Consequently, the contacts 19 and 33 remain open while the contacts 32 are closed by the winding K1 to energize the signal lamp 31 and thereby indicate the flow of supervisory current through the circuit connecting the activator squibs 33. However, any disruption in the continuity of that circuit produced, for example, by either an open circuit or an individual squib 33 with an abnormally high resistance, interrupts base current flow to shut off the transistor Q1. The resultant de-energization of the relay winding K1 opens the contacts 32 to de-energize the lamp 31 and thereby visually indicate the circuit failure. Having observed the de-energized light 31, maintenance personnel can locate and correct the fault to restore system integrity. During normal conditions, all the other modules M2–M6 in the system 11 operate in an identical fashion.

In response to an abnormal envionmental condition such as a fire or an incipient fire, the sensor 12 closes the contacts 10 completing a circuit that connects the winding K2 directly across the supply. The resultant increased current flow of, for example, greater than 40 milliampures energizes the winding K2 to close the contacts 33 and 19. Closure of the initiator contacts 33 connects the series string of activator squibs 33 directly across the supply and results in a flow of current therethrough sufficient to detonate the squibs 34 and thereby release the fire extinguishing medium contained in the vessels 35. In an identical manner the closure of the sensor contacts 10 effects release of extinguishing agent in the module M2. Thus, the modules M1 and M2 ae simultaneously activated by the sensor 12 to release their fire suppressing agents in response to detection of the abnormal condition.

The activation of the module M1 also closes the response contacts 19 to thereby close circuits via the lines 17 and 18 in each of the modules M3 and M4. These closed circuits operate as described above in connection with module M1 to activate extinguishing agent release. Simultaneously, the closure of the contacts 23 in response to activation of the module M2 also completes through lines 21 and 22 the circuits that activate the initiator circuits in each of the modules M3 and M4. Similarly, activation of the module M3 results in closure of the responsive contacts 26 completing circuits through lines 24 and 25 that activate initiator circuits in each of the additional modules M5 and M6. Activation of these modules is further insured by the closure of the contacts 29 in response to activation of the module M4.

A review of the above described operation illustrates that the failure of any single module in the system 11 will not prevent operation of all other modules in the system. For example, a failure in either of the first modules M1 and M2 will not prevent activation of the other directly by closure of the detector contacts 10. Also activation of either module M1 or M2 will insure through its associated response contacts the activation of both of the modules M3 and M4. In the same manner the failure of either of the modules M3 and M4 will not prevent operation of the additional modules M5 and M6 in that activaton of either module M3 or M4 insures activation of both the modules M5 and M6.

It will be obvious that the above described operation can be obtained in systems employing any number of additional interconnected groups of modules. For a typical application, the system 11 would be designed with an extinguishing agent capacity entailing at least one module in excess of that required to fully protect the volume in which the system is installed. Accordingly, the volume is fully and reliably protected even in the event that one particular module in the system fails to operate.

Obviously many modifications and variations of the present invention are possible in light of the above teachings. It is therefore to be understood that within the scope of the appended claims, the invention can be practiced otherwise than as specifically described.

What is claimed is:

1. An electrical protection system comprising:

a plurality of suppressor modules, each of said modules comprising a plurality of suppressor units activatable to suppress an abnormal condition, an activator associated with each of said units and energizable by a given level of electrical current flow to induce activation thereof, series circuit means connecting said activators in series, and an initiator circuit activatable to induce said given level of electrical current flow to said activators;

detector means for sensing the abnormal condition and activating said initiator circuits in a first plurality of said modules in response thereto; and response means for activating said initiator circuits in another plurality of said modules in response to activation of said initiator circuits in any of said first plurality of modules.

2. A system according to claim 1 including additional response means for activating said initiator circuits in an additional plurality of said modules in response to activation of said initiator circuits in any of said another plurality of modules.

3. A system according to claim 1 wherein said response means comprises delay means for delaying activation of said initiator circuits in said another plurality of modules after activation of said initiator circuits in any of said first plurality of modules.

4. A system according to claim 3 wherein said delay means comprises a relay means with winding means energized in response to activation of said initiator circuits in any of said first plurality of modules, and contact means operated by said relay means to activate said initiator circuits in said another plurality of modules.

5. A system according to claim 4 wherein said suppressor units comprise vessels containing a fire suppressing agent.

6. A system according to claim 5 wherein said activators comprise explosive squibs for inducing release of said suppressing agent from said vessels.

7. A system according to claim 5 wherein said detector means comprises thermal detection means.

8. A system according to claim 1 including supervision circuit means for supplying a supervisory current flow through all of said series connected activators, said supervisory current flow being less than said given level of current flow required to activate said activators.

9. A system according to claim 8 wherein said response means comprises delay means for delaying activation of said initiator circuits in said another plurality of modules after activation of said initiator circuits in any of said first plurality of modules.

10. A system according to claim 9 including additional response means for activating said initiator circuits in an additional plurality of said modules in response to activation of said initiator circuits in any of said another plurality of modules.

* * * * *